United States Patent [19]

Madden

[11] 3,933,543

[45] Jan. 20, 1976

[54] PROPELLANT COMPOSITIONS CONTAINING A STAPLE METAL FUEL

[75] Inventor: Dale A. Madden, Fairfax County, Va.

[73] Assignee: Atlantic Research Corporation, Alexandria, Va.

[22] Filed: Jan. 15, 1964

[21] Appl. No.: 337,955

[52] U.S. Cl. ..... 149/21; 149/37; 149/42; 149/44; 149/76; 149/114; 102/103

[51] Int. Cl. ..... C06b 15/00

[58] Field of Search ..... 102/98, 103; 149/2, 19, 149/44, 21, 37, 42, 96, 114

[56] References Cited

UNITED STATES PATENTS

| | | | |
|---|---|---|---|
| 2,844,458 | 7/1958 | Hillman | 149/37 |
| 3,022,735 | 2/1962 | Eberle | 102/98 |
| 3,109,374 | 11/1963 | Rumbel et al. | 149/2 X |
| 3,138,497 | 6/1964 | Kennedy et al. | 149/21 X |
| 3,162,558 | 12/1964 | Bishop et al. | 149/21 X |
| 3,163,113 | 12/1964 | Davis et al. | 149/44 X |
| 3,464,869 | 9/1969 | Wystrach et al. | 149/42 X |
| 3,506,713 | 4/1970 | Sayles | 149/42 X |
| 3,791,892 | 2/1974 | Hammond et al. | 149/20 X |

*Primary Examiner*—Benjamin R. Padgett
*Assistant Examiner*—P. A. Nelson
*Attorney, Agent, or Firm*—Martha L. Ross

[57] ABSTRACT

A gas-generating composition comprising an oxidizer, a non-metal, preferably organic, fuel component, and a metal fuel staple component of a particular size.

20 Claims, No Drawings

PROPELLANT COMPOSITIONS CONTAINING A STAPLE METAL FUEL

This invention relates to new and improved propellant compositions of exceedingly high propulsive performance. More particularly, it relates to propellant compositions and grains containing particulate metal having a flat configuration, hereinafter called staples, which greatly increase both the effective burning rate and the ballistic performance of the propellant.

The development of propellant compositions having increased burning rates and improved propulsive performance has proceeded with vigor throughout recent years. Heretofore, increases in the burning rate have been obtained primarily by optimizing proportions of the ingredients within the propellant matrix and/or by the addition of materials such as burning rate catalysts. These expedients, however, have little or no effect on the ballistic parameters, that is, specific impulse and/or boost velocity, of the propellant.

Recently, it has been found that the addition of certain high energy metal powders, e.g., aluminum, beryllium, zirconium, magnesium, etc., to propellant compositions greatly improves the ballistic performance, that is, specific impulse and/or boost velocity, of the propellant. However, these metal additives generally do not increase the burning rate and, in many cases, actually lower it.

Accordingly, it is the object of this invention to provide propellant compositions having both an increased burning rate and improved propulsive performance.

Still a further object is to provide propellant compositions which can be tailored to a desired burning rate and propulsive performance.

These and other objects and advantages will become apparent from the following detailed description.

I have discovered that large increases in both the burning rate and ballistic performance, that is, the specific impulse and/or boost velocity, of propellant compositions can be obtained by distributing in intimate contact with the propellant, and thereby with its oxidizer component, a plurality of high-energy-contributing metal fuel staples, selected from among aluminum, beryllium, magnesium, zirconium, tungsten and titanium, and alloys and mixtures thereof, and having a maximum thickness of about 0.001 inch and a maximum ratio of thickness to width of about 1 to 4.

The utilization of the aforementioned metal staples which react with an oxidizer to produce a high exothermic heat of combustion, heats the propulsive gases evolved during the combustion of the propellant to a very high temperature. This increases considerably the thrust of the gases and, consequently, the ballastic performance. In addition, and quite surprisingly, is the further discovery that the presence of a metal in the form of staples increases ballistic performance as much as finely-divided metallic powders. It would appear that the addition of the larger staples, because of their apparent inability to oxidize completely, would decrease the thrust of the propellant, thus lowering its propulsive performance. However, because of the aforementioned dimensional limitations of the metal staples, an extremely large surface area relative to the volume is in intimate contact with and, therefore, available for combustion by, the oxidizer within the surrounding propellant matrix. This permits the oxidizer readily and completely to burn or consume the metal staples, forming the oxide of the metal.

The high-energy-contributing metals employed in fabricating the staples have a substantially higher thermal diffusivity than the propellant material and/or a relatively high melting point. Table I shows the thermal diffusivity and the melting points of these metals.

TABLE I

| Metal | Thermal Diffusivity ($Cm^2$/sec) | Melting Point (°C) |
|---|---|---|
| Aluminum | 0.94 | 660 |
| Beryllium | 0.51 | 1350 |
| Magnesium | 0.66 | 651 |
| Zirconium | 0.11 | 1700 |
| Tungsten | 0.67 | 3370 |
| Titanium | 0.68 | 1800 |

The increased burning rate of the propellant is partially due to the fact that the metal staples, having a much higher thermal diffusivity than the other propellant material or its gaseous combustion products, effect rapid heat transfer from the high temperature combustion gases in the flame zone to the unburned portions of the propellant, so that the flame propagates rapidly along the propellant adjacent to the metallic staples. As a result, the rate of propagation of the burning surface along the metallic staples is many times the normal propellant matrix burning rate. Furthermore, because of their dimensions, a large surface area relative to the cross-sectional area is available for heat transfer from the hot flame area through the staple and into the unburned portion of the propellant.

Another important property which determines the efficacy of the particular metal for increasing the burning rate is the melting point. Apparently, the higher the melting temperature of the metal staple, the larger is the area which projects into the flame zone as the surrounding propellant matrix burns away. This provides a greater area for heat transport from the hot gases to the staple. Thus, in the case of a metal such as zirconium, its high melting point compensates for its relatively low thermal diffusivity.

In addition to the dimensions previously set forth, the maximum ratio of the width to the length of the consumable metal staples is one to one. The width and length of the staples can vary over a wide range limited only by such considerations as processibility of the propellant mix, weight and number of staples desired, etc. The length can vary from about 2 inches to about 0.03 inch, preferably from about 0.5 inch to about 0.03 inch. The staples can be employed flat or in any other desirable configuration, e.g., U-shaped, angled, rounded, tubular, etc., so long as they adhere to the The metal staples can be dispersed in the propellant material in a more or less random pattern, for example, by mixing them with the propellant prior to extrusion or casting. However, additional improvement in burning rates can be obtained by orienting the staples in the direction of flame propagation, namely, substantially normal to the burning surface. This can be accomplished, for example, by extrusion of the propellant material through a die having converging funnels which align the staples in the direction of burning.

The proportion of metal staples introduced into the propellant matrix is not critical, although this is one of the factors which determines the specific increase in ballistic performance or burning rate. In other words, even the addition of a very small amount will effect some increase. In most cases, it is desirable to add at least about 0.5% and, preferably, at least about 1% by weight of the propellant to obtain appreciable results. In general, the larger the quantity of metal staples added, the higher will be the effective burning rate. However, the amount incorporated will be controlled by a number of factors such as the desired burning rate, ballistic performance and processibility of the final propellant mix. For this reason, it will generally be undesirable to add more than about 10 to about 30% by weight of the propellant, although, in some cases, larger amounts may be feasible.

The metal staples can be the sole burning rate- or energy-increasing metal ingredient present in the propellant composition or they can be supplemented with burning rate catalysts and/or high-energy-contributing metals in other forms, e.g., powdered. The use of such powdered metals in conjunction with the staples is particularly advantageous since it permits the tailoring of propellant compositions to desirable combinations of burning rate and ballistic performance, while reducing processiblity problems. Thus, for example, it is not possible with additional metal staples to increase the ballistic performance of a specific propellant composition while maintaining substantially the same burning rate. Furthermore, processibility problems increase with the addition of the staples. However, the desired additional increase in ballistic performance along with a minimal increase in processibility problems, can be obtained easily by the utilization of minor amounts of metal powders. The powdered metal fuel species can be the same as the staples or can be different. Aluminum staples, for example, can be employed in combination with powders, beryllium, magnesium, zirconium, etc.

The embedded metal staples are effective regardless of the specific nature or composition of the propellant although the specific increase in ballistic performance and burning rate will vary to some extent according to the specific propellant composition. They can be employed, for example, with composite type propellants which comprise an organic fuel matrix component and an additional oxidizer component. The organic fuel matrix can be any suitable organic compound or mixture of organic compounds which contains molecularly combined carbon and hydrogen. It can be "inert", the term "inert" as used herein meaning a compound which requires an added oxidizer for combustion. Illustrative of suitable organic matrix compositions are the various solid polymeric binders, such as polyether polysulfides, polyurethanes, butadiene-acrylic acid and -methacrylic acid copolymers cross-linked with an epoxy, alkyd polyesters, polyamides, cellulose esters, e.g., cellulose acetate, cellulose ethers, e.g., ethyl cellulose, polyvinyl chloride, asphalt, and the like. As shown by the illustrative examples, the inert fuels, in addition to requiring an oxidizer for combustion, are also inert in that they do not react with the metal staples, or at least do not react to a degree sufficient to contribute substantially to the total heat of combustion of the propellant composition.

The organic fuel matrix can also comprise an active organic compound, a mixture of such compounds, or a mixture of such a compound with an inert organic compound, such as an inert organic plasticizer. The term "active" compound as employed herein means a compound which contains molecularly combined oxygen available for combustion of other components of the molecule, such as carbon. Examples of active organic fuel compounds include those containing nitroso, nitro, nitrite, and nitrate radicals, such as cellulose nitrate and nitroglycerine.

The metal staples can also be employed in semi-solid, monopropellant systems. Such compositions are thixotropic, cohesive, shape-retentive compositions which can be extruded under moderate pressures into the combustion chamber of a rocket, where they form continuously advancing columns which burn on the exposed surface, or can be loaded directly into the combustion chamber of specially-designed gas-generators or motors. Such plastic monopropellant compositions can comprise a stable dispersion of a finely-divided, insoluble oxidizer and the metal staples in a continuous matrix of any suitable high-boiling liquid fuel. Illustrative of suitable liquid fuels are hydrocarbons, such as triethyl benzene, liquid polyisobutylene, and the like; organic esters, such as dimethyl maleate, dibutyl oxalate, dibutyl phthalate; alcohols, such as benzyl alcohol and triethylene glycol; ethers, such as methyl-naphthyl ether; hydrazine and its methyl derivatives; and many others.

Any solid insoluble, finely-divided oxidizer can be employed which yields oxygen readily for combustion of the metal staples and the fuel matrix. Such oxidizers include the inorganic oxidizer salts, such as $NH_4$, K, Na, and Li perchlorates and nitrates; metal peroxides, such as $CaO_2$, $BaO_2$, and $Na_2O_2$; hydrazine nitroformate, hydrazine nitrate, nitronium perchlorate, and the like; and organic oxidizers such as pentaerythritol tetranitrate, hexanitroethane, mannitol hexanitrate, and the like; the inorganic salts being preferred.

The metal staples can also be employed with the well known solid or semi-solid double base type of propellants in which the oxidizing component and fuel component can be combined in the same compounds. Such propellants comprise, for example, nitrocellulose plasticized with an oxidant-type organic liquid plasticizer, containing active oxidizing groups such as nitro, nitrate, nitrite and nitroso groups, e.g., nitroglycerine, diethylene glycol dinitrate, pentaerythritol trinitrate, 1,2,4-trinitro-butane and the like, or a mixture of such an oxidant-type plasticizer with an inert fuel component such as a liquid plasticizer, as, for example, sebacates, such as dibutyl sebacate and dioctyl sebacate; phthalates, such as dibutyl phthalate and dioctyl phthalate; adipates, such as dioctyl adipate; glycol esters of higher fatty acids; etc. The previously mentioned insoluble solid oxidizers can also be incorporated into the double-base propellant compositions.

The propellant compositions can also contain additional conventional propellant ingredients, of which the following are exemplary only; burning rate catalysts such as copper chromite and iron oxide, stabilizers such as ethyl centralite and 2-nitrodiphenylamine, etc.

The ingredients employed in making the propellants can be mixed together in any sequence using processing techniques well known to the propellant technician to control the consistency, homogeneity, etc., of the mixture. If a solid grain is to be produced from the mixture it can then be formed of any desired configuration by any well known procedure such as molding, casting, extrusion, etc.

The following specific examples are presented to illustrate the increased mass burning rates and/or the improved ballistic performance, e.g., specific impulse, imparted to the propellants by the addition of metal staples, but it will be understood, are in no way limiting.

EXAMPLE I

Propellant grains having the following compositions were fabricated by homogeneously mixing the ingredients and then casting the mixtures. During combustion, the burning rate of the formulation and the specific impulse of the grain were measured and are given below.

| Composition | Per Cent by weight A | B | C |
|---|---|---|---|
| Butarez CTL (Carboxy-terminated polybutadiene polymer) | 8.28 | 8.28 | 8.28 |
| MAPO[1] | 0.31 | 0.31 | 0.31 |
| IDP[2] | 5.41 | 5.41 | 5.41 |
| Ammonium perchlorate | 64.00 | 64.00 | 64.00 |
| Copper Chromite | 1.00 | 1.00 | 1.00 |
| Aluminum powder | 21.00 | 19.00 | 17.00 |
| Aluminum staple[3] | — | 2.00 | 4.00 |
| Burning rate (1000 psi, 70°F) | .53 | .71 | 1.00 |
| Specific impulse (lb-sec/lb) | 232.30 | 229.20 | 233.40 |

[1]tris [1-(2-methyl) aziridinyl] phosphine oxide
[2]isodecylpelargonate
[3]size of staple .125" × .0025" × .0005"

From a comparison of the burning rates and specific impulses of compositions A, B, and C, it is obvious that the use of mixtures of aluminum staples and aluminum powder greatly increases the burning rate while the specific impulse remains substantially constant.

EXAMPLE II

Aluminum staples which differ considerably in their dimensions were substituted for aluminum powder in the following solid propellant formulation. The burning rates at 70°F and 1000 psia were determined and are set forth in Table II.

| Composition | Weight Per Cent |
|---|---|
| Ammonium perchlorate | 58.90 |
| Polyvinyl chloride | 8.19 |
| Dioctyl adipate | 10.56 |
| British Detergent* | .25 |
| Aluminum powder | 21.10 |
| Copper Chromite | 1.00 |
| | 100.00 |

*Equal parts of glyceryl monooleate, pentaerythritol dioleate, and dioctyl sodium sulfosuccinate.

TABLE II

| Staple Dimension | Aluminum staple substituted for aluminum powder (weight per cent of total propellant compositions) 2 | 5 | 8 | 10 | 15 | 20 |
|---|---|---|---|---|---|---|
| A | 1.35* | 1.47 | 1.55 | 1.60 | 1.65 | 1.70 |
| B | 1.48 | 1.61 | 1.70 | 1.75 | 1.80 | 1.85 |
| C | 1.50 | 1.63 | 1.72 | 1.77 | 1.82 | 1.87 |
| D | 1.55 | 1.67 | 1.75 | 1.80 | 1.86 | 1.90 |
| E | 1.55 | 1.67 | 1.75 | 1.80 | 1.86 | 1.90 |
| F | 1.61 | 1.75 | 1.83 | 1.89 | 1.92 | 1.96 |
| G | 1.71 | 1.85 | 1.90 | 1.95 | 2.02 | 2.08 |
| H | 1.73 | 1.88 | 1.94 | 1.98 | 2.05 | 2.13 |

*Burning rates at 70°F and 1000 psia

| Aluminum staple dimensions in inches |
|---|
| A — 0.035 × 0.005 × 0.00035 |
| B — 0.375 × 0.0045 × 0.0007 |
| C — 0.063 × 0.0045 × 0.0007 |
| D — 0.035 × 0.005 × 0.0005 |
| E — 0.050 × 0.004 × 0.0005 |
| F — 0.125 × 0.005 × 0.0005 |
| G — 0.125 × 0.0045 × 0.0007 |
| H — 0.125 × 0.0025 × 0.0005 |

From Table II it can readily be seen that the increase in burning rates can be obtained by the use of metal staples of various dimensions within the aforedescribed limitations.

EXAMPLE III

Propellants having the following indicated compositions were fabricated by mixing small spheres of the polymerized resin binder with the other ingredients. The resulting fluid, heterogeneous mixture, was then cast. Burning rates at 70°F and a pressure of 1000 psi were then determined for each formulation.

| Composition | Per cent by weight | | |
|---|---|---|---|
| Ammonium perchlorate | 58.90 | 58.90 | 58.90 |
| Polyvinyl chloride | 8.62 | 8.62 | 8.62 |
| Dioctyl adipate | 10.79 | 10.79 | 10.79 |
| Advance XE82[4] | .17 | .17 | .17 |
| Advance BC74[5] | .17 | .17 | .17 |
| British detergent[6] | .25 | .25 | .25 |
| Aluminum powder (5 micron) | 21.10 | 20.05 | 16.88 |
| Aluminum staples[7] | — | 1.05 | 4.22 |
| Burning rate (1000 psi, 70°F) | .40 | .72 | .92 |

[4]Epoxy modified ether-ester type heat and light stabilizer
[5]Liquid barium-cadmium carboxylate stabilizer containing auxiliary organo phosphate heat and light stabilizers
[6]Equal parts of glyceryl monooleate, pentaerythritol dioleate, and dioctyl sodium sulfosuccinate
[7]Size of staples .31" × .0045" × .0007"

In each instance an increase in the amount of aluminum staples increased the burning rate.

EXAMPLE IV

In order to show the improved burning rate obtained by the addition of aluminum staples to a propellant composition the following solid propellants were fabricated.

| Composition | Per cent by weight | |
|---|---|---|
| Polyvinyl chloride | 8.44 | 8.44 |
| Dioctyl adipate | 10.23 | 10.23 |
| British Detergent[8] | .25 | .25 |
| Carbon black | .05 | .05 |
| Ammonium perchlorate | 81.03 | 59.93 |
| Aluminum staples[9] | — | 21.10 |
| Burning rate (1000 psi) | .66 | .97 |

[8]Equal parts of glyceryl monooleate, pentaerythritol dioleate and dioctyl sodium sulfosuccinate
[9]Size of staple .03" × .03" × .0008"

As can be ascertained from the above data, the addition of large amounts of aluminum staples improves the burning rate considerably.

Additional increases in the burning rates of any of the aforementioned propellant compositions over and above the increases effected by high-energy metal staples, such as aluminum, can be obtained by the addition of a minor amount of a metal staple of silver or copper. Surprisingly, large increases in the burning rates are obtained by substituting for a portion of the aluminum staples an equal amount by weight of silver or copper staples. To illustrate, the following solid propellant formulation, containing only aluminum powder was prepared and the burning rate was determined.

EXAMPLE V

| Composition | Per cent by weight | |
|---|---|---|
| Carboxy-terminated polybutadiene polymer | 8.61 | |
| MAPO[10] | .39 | |
| IDP[11] | 5.00 | |
| Ammonium perchlorate (25 micron) | 38.00 | |
| Ammonium perchlorate (200 micron) | 38.00 | |
| Aluminum powder (5 micron) | 10.00 | |
| Burning rate (1000 psia, 70°F) | .35 | in/sec. |

[10]Tris [1-(2-methyl) aziridinyl] phosphine oxide
[11]isodecylpolargonate

Various portions of the aluminum powder in the above composition were replaced by aluminum, silver or copper staples and the burning rates of the resulting formulations, are presented as follows:

| Sample | Metallic Staple Per cent by weight | Burning Rate (1000 psia, 70°F) | Copper Chromite Per cent by weight |
|---|---|---|---|
| D | 4% silver, copper or aluminum[12] | .53 to .57 | — |
| E | 4% aluminum | 1.12 | 2% |
| F | 2% aluminum, 2% silver | 1.41 | 2% |
| G | 2% aluminum, 2% silver (Finer grind $NH_4ClO_4$ than in D, E, and F) | 1.85 | 2% |
| H | 2% aluminum, 2% copper (Same oxidizer as in sample G) | 1.68 | 2% |

[12]Size of all staples was about .125" × .002" × .0005"

As can be seen from sample D, equal additions of the three types of staples on a weight per cent basis give substantially the same increase in burning rate. It would normally be expected that silver and copper, because of their high thermal diffusivity and considerably higher melting point than aluminum, would produce higher burning rates than the latter. However, on a weight-percentage basis for a given size of staple, the higher densities of silver and copper reduces the total number of staples and, therefore, the effective increase in burning rate.

| Metal | Thermal Diffusivity 650°F (cm 2/sec) | Melting Point °C | Density g/ml |
|---|---|---|---|
| Silver | 1.23 | 960 | 10.53 |
| Copper | 0.90 | 1083 | 8.96 |
| Alumi-num | 0.94 | 660 | 2.70 |

From this it would be expected that any combination of the three kinds of staples on an equal weight percentage basis would give approximately the same burning rates. However, it is apparent that the substitution of half of the aluminum from sample E by an equal weight per cent of silver gives an unexpectedly high burning rate as shown in sample F. Since the weight per cents are equal, it is evident that a synergistic, rather than an additive, effect is obtained. This effect is even more pronounced when the proportions of the finer oxidizer grind of sample G are employed. It is also evident from the greatly increased burning rate obtained in sample H that a similar effect is obtained when half of the aluminum is substituted with an equal weight per cent of copper.

It will be understood that the metal fuel staples of the invention can be employed in the form of a single metal species, or a mixture of different fuel metal species, either by admixture of staples each of a sole metal species or in the form of alloys of two or more of the specified fuel metals. The metal fuel staples can also comprise adherent metal layers of different species in the thickness dimension, as, for example, aluminum and zirconium. In some cases, it may be desirable to coat the metal fuel staple, such as aluminum, with either a different metal fuel, such as zirconium, or with a non-energy contributing metal, such as silver or copper.

The preceding propellant compositions can be used in solid end-burning grains or can also be applied very advantageously to other types of propellant grains, such as perforated grains.

Although this invention has been described with reference to illustrative embodiments thereof, it will be apparent to those skilled in the art that it may be embodied in other forms within the scope of the appended claims.

I claim:

1. In a propellant composition comprising an oxidizing component selected from the group consisting of inorganic perchlorates or nitrates, metal peroxides, hydrazine nitroformate, and mixtures thereof, a non-metal fuel component selected from the group consisting of inert fuels and fuels rendered active by molecularly combined nitroso, nitro, nitrite or nitrate groups, and mixtures thereof and a metal fuel component, the improvement in which the metal is selected from the group consisting of aluminum, beryllium, zirconium, magnesium, titanium, tungsten, alloys thereof, and mixtures thereof, and is in the form of staple having a maximum thickness of about 0.001 inch, a maximum ratio of thickness to width of about 1 to 4, a minimum length of about 0.03 inch and a maximum ratio of width to length of about 1 to 1.

2. The composition of claim 1 in which the metal staple is aluminum.

3. The composition of claim 2 which additionally contains a minor amount by weight, of the total composition, of metal staple selected from the group consisting of silver and copper.

4. The composition of claim 1 in which the propellant composition contains, in addition to said staple, a metal fuel component in the form of a finely divided powder.

5. The composition of claim 4 in which the metal staple is aluminum.

6. The composition of claim 5 which additionally contains a minor amount by weight, of the total composition, of metal staple selected from the group consisting of silver and copper.

7. The composition of claim 1 in which the non-metal fuel component is an organic compound.

8. The composition of claim 7 in which the organic compound is a polymer.

9. The composition of claim 8 in which the oxidizing component is a solid, insoluble, finely divided inorganic oxidizer.

10. The composition of claim 9 in which the metal staple is aluminum.

11. The composition of claim 10 which additionally contains a minor amount by weight, of the total composition, of metal staple selected from the group consisting of silver and copper.

12. The composition of claim 9 in which the oxidizer is ammonium perchlorate.

13. The composition of claim 12 in which the metal staple is aluminum.

14. In a gas-generating composition comprising an oxidizing component selected from the group consisting of inorganic perchlorates or nitrates, metal peroxides, hydrazine nitroformate, and mixtures thereof, a non-metal fuel component selected from the group consisting of inert fuels and fuels rendered active by molecularly combined nitroso, nitro, nitrite or nitrate groups, and mixtures thereof, and a metal fuel component, the improvement in which the metal is selected from the group consisting of aluminum, beryllium, zirconium, magnesium, titanium, tungsten, alloys thereof, and mixtures thereof, and is in the form of staple having a maximum thickness of about 0.001 inch, a maximum ratio of thickness to width of about 1 to 4, a minimum length of about 0.03 inch and a maximum ratio of width to length of about 1 to 1.

15. The composition of claim 14 in which the metal staple is aluminum.

16. The composition of claim 2 which additionally contains, in a minor amount by weight of the total composition, metal staple selected from the group consisting of silver and copper.

17. The composition of claim 14 in which the composition contains, in addition to said staple, a metal fuel component in the form of a finely divided powder.

18. The composition of claim 14 in which the non-metal fuel component is an organic compound.

19. The composition of claim 18 wherein said organic compound is a polymer.

20. The composition of claim 19 in which the oxidizing component is a solid, insoluble, finely divided inorganic oxidizer.

* * * * *

UNITED STATES PATENT OFFICE

CERTIFICATE OF CORRECTION

Patent No. 3,933,543 Dated 20 January 1976

Inventor(s) Dale A. Madden

It is certified that error appears in the above-identified patent and that said Letters Patent are hereby corrected as shown below:

Column 2, line 52, end of line, after "the", insert --aforedescribed dimensional limitations--.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*